United States Patent [19]

Mancke

[11] 3,971,654

[45] July 27, 1976

[54] METHOD OF INJECTING PELLETIZED COAL THROUGH BLAST FURNACE TUYERES

[75] Inventor: Edgar B. Mancke, Bethlehem, Pa.

[73] Assignee: Bethlehem Steel Corporation, Bethlehem, Pa.

[22] Filed: Oct. 16, 1974

[21] Appl. No.: 515,289

[52] U.S. Cl. ..... 75/42

[51] Int. Cl.[2] ..... C21B 5/00

[58] Field of Search ..... 75/41, 42; 44/10 R

[56] References Cited

UNITED STATES PATENTS

| | | | |
|---|---|---|---|
| 1,349,598 | 8/1920 | Basset | 75/42 |
| 3,150,962 | 9/1964 | Pearson | 75/42 |
| 3,167,421 | 1/1965 | Pfeiffer et al. | 75/42 |
| 3,197,304 | 7/1965 | Agarwal | 75/42 |
| 3,240,587 | 3/1966 | Schmidt | 75/42 |
| 3,655,350 | 4/1972 | Utley | 44/10 R |
| 3,756,791 | 9/1973 | Mancke | 44/10 R |
| 3,775,070 | 11/1973 | Messer | 75/42 |

OTHER PUBLICATIONS

Deurbrock AW Bureau Mines Report 7633, 1972 pp. 1–19.

*Primary Examiner*—M. J. Andrews

*Attorney, Agent, or Firm*—Joseph J. O'Keefe; William B. Noll

[57] ABSTRACT

Fueling a blast furnace by the injection of pelletized coal through hot blast tuyeres improves blast furnace operating efficiency. Pelletizing provides means for using fine coal, more effective removal of pyritic sulfur and an improved fuel which rolls rather than slides. Rolling pellets resist melting during lance injection through hot blast tuyeres better than sliding particles of coal. Pelletizing of fine coal enhances the suitability of a wide variety of coals for replacing coke as a blast furnace fuel.

8 Claims, 8 Drawing Figures

FIG. 1

METHOD OF INJECTING PELLETIZED COAL THROUGH BLAST FURNACE TUYERES

BACKGROUND OF THE INVENTION

This invention pertains to pelletized coal and method of injecting same through blast furnace tuyeres. In a conventional blast furnace used for the production of molten iron, the burden charged into the top of the furnace may contain iron oxide, partially reduced iron oxide, coke, limestone and fluxes. Air in the form of a hot blast, which may be enriched with oxygen, in introduced through tuyeres located in the side of the furnace between the smelting zone and hearth section which contains the molten iron.

The coke portion of the burden normally supplies the fuel and an excess of coke provides a porous support for the balance of the burden so that the hot blast entering through the tuyeres can move through the burden and exit through the top of the furnace. The hot blast is essentially heated air and consumes a portion of the coke to provide heat and the combustion products thereof serve to reduce iron oxides and produce molten iron.

The detrimental effect of sulfur on the quality of pig iron produced in the blast furnace is well known. It is also known that the sulfur content of the iron is directly related to the total sulfur contained in the blast furnace burden. Low sulfur is a well known essential requirement for coking coal and this need is a well known contributor to the high cost and short supply of good metallurgical coke. This is true even though the coking process is known to reduce the total amount of sulfur in a coking coal.

It is known to replace a portion of the coke in the burden by introducing other fuels through the blast furnace tuyeres. These other fuels include a wide variety of fluids and solids. In general, fluid fuels such as natural gas, oil, tar, and pitch have been used satisfactorily both individually and in various combinations to reduce the amount of coke in the blast furnace burden. Solid fuels, such as coal, have also been used to reduce the amount of the coke portion of the burden but coal has not had wide acceptance as a replacement for a portion of the coke burden. Reasons for the general unacceptability of blast furnace tuyere coal injection are not completely understood but the following objections to such use of coal have been noted:

(1) Low sulfur is a primary requisite of coking coals for blast furnace use because the total amount of sulfur in the blast furnace burden finds its way into either the slag or molten iron. It is known that the coking of coal removes a portion of the sulfur in the coal so that the metallurgical grade of coke contains less sulfur than the coal.

(2) Known methods for removing sulfur from coal include crushing and separation of coal particles on the basis of size and/or density. It is also known that crushing of some coals results in the production of large amounts of very fine particles which can be detrimental to free flow of fine coal. In addition, the presence of moisture has a variable effect on different coals and moisture may result in the formation of lumps which tend to pack and cause difficulty in the transportation of fine coal. The combination of particle size and moisture content of crushed coal imposes some restriction on the selection of suitable coals for blast furnace injection.

(3) The preferred size of crushed coal for blast furnace injection is about 10 mesh. Large amounts of very fine coal, e.g. 100 mesh, are undesirable because they may form explosive mixtures, are of low density and do not flow well. Coal crushed to sizes coarser than about 10 mesh may be unsuitable for blast furnace injection because combustion is too slow. It is also known that very fine coal is objectionable from the pollution standpoint and fine coals are subject to losses in storage and transit.

(4) The lances used to inject crushed coal through blast furnace tuyeres are exposed to the temperature of the hot blast. These injection lances are known to be subject to plugging which causes erratic blast furnace performance. In addition, rodding to remove plugs from injection lances is dangerous and can add significant labor costs to coal injection.

Examples of prior art patents pertaining to the blast furnace injection of coal include the following:

U.S. Pat. No. 1,349,598 issued Aug. 17, 1920 to L. P. Bosset for "Process of Treating Ores in Blast Furnaces" discloses the injection of fine and coarse carbon (coal) through the tuyeres.

U.S. Pat. No. 3,167,421 issued Jan. 26, 1965 to R. W. Pfeiffer et al for "Powdered Solid Injection Process" is directed to a method for the gaseous injection of solid material such as coal into a reaction vessel such as a blast furnace.

U.S. Pat. No. 3,240,587 issued Mar. 15, 1966 to L. D. Schmidt for "Method of Injecting Particulate Coal into a Blast Furnace" is directed to a method introducing preheated coal into a blast furnace.

None of these prior art patents mention pelletized coal and it has not been previously recognized that the injection of pelletized coal improved the blast furnace operation and the quality of the pig iron.

The principal object of this invention is the injection of pelletized coal so as to improve the operation of a blast furnace.

Another object of this invention is to provide a pelletized coal which is particularly adapted for blowpipe injection through blast furnace tuyeres.

Still another object of this invention is the blast furnace injection of coal pellets containing less sulfur than the coal as mined.

A further object of this invention is to reduce the coke portion of the burden of a blast furnace by providing a portion of the fuel for the furnace by the lance injection of rounded low sulfur pelletized coal through the hot blast tuyeres.

A still further object of this invention is to improve the operation of a blast furnace by replacing a portion of the coke of the burden by lance injecting rounded, low sulfur pelletized coal through the hot blast tuyeres so as to provide a fuel resistant to plugging of injection lances.

SUMMARY OF THE INVENTION

Broadly, this invention is directed to the method of operating a blast furnace for the smelting of iron wherein low sulfur, pelletized coal is injected through the side of the furnace by means of lances entering the furnace through the hot blast tuyeres.

It has not been previously recognized that the injection of pelletized coal provides means for improving the operation of blast furnaces. Blast furnace injection of coal, of the prior art includes the selection of coal on the basis of fracture characteristics to avoid the production of excessive amounts of fine particles so as to provide coarse coal particles having good flow characteristics. Selection of coals to maximize coarse particles is in direct opposition to the finding that shows the efficiency of separating pyritic sulfur from coal is improved by reducing the particle size. The combination of low sulfur and coarse particle size severely limits the selection of suitable coals for blast furnace injection.

Figure 1:
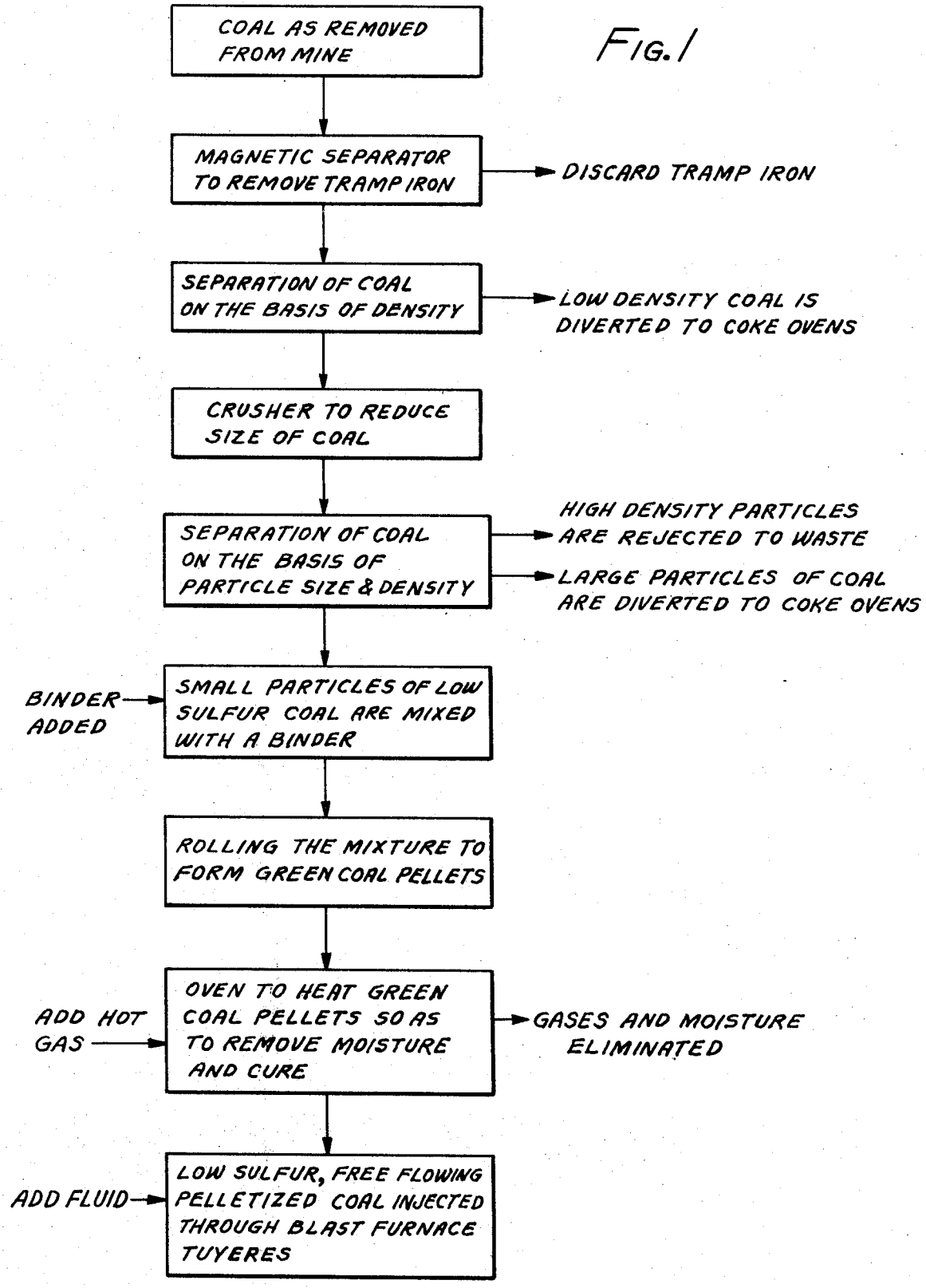
FIG. 1 is a drawing of a block flow diagram illustrating the sequence of processing steps of this invention.

In FIG. 1 the first step in the production of pelletized coal intended for blast furnace injection is to run the coal as removed from the mine through a magnetic separator so as to remove and discard tramp iron as is well known in the art. The second step is the flotation separation of coal on the basis of density as is well known in the art. Low density coal containing little or no pyritic sulfur is diverted to the coke ovens and the high density coal containing pyritic sulfur is maintained in the system. The third step is to crush the random sized high density coal particles by any of the well known methods of grinding, such as with a hammer moll. The method of reducing the size of the coal particles is not critical and the selection of the particular apparatus for reducing the size of the coal will vary depending on the crushability of the coal from different sources. The fourth step is the separation of the crushed coal on the basis of particle size and density by any combination of wet (cyclones) or dry (screens) methods as is well known in the art. The selection of coal separating equipment is not critical and will depend on the well known difference in the crushability and density of coal from different mines. The method of this invention is intended to use the very fine crushed coal remaining after discarding the high density particles which include ash forming rocks and large particles of coal which are diverted to coke ovens. This very fine crushed coal may include a significant quantity of coal which will pass through a 100 mesh screen and provides the principal source of the coal pellets of this invention and which heretofore has been considered to be very undesirable. The fifth step is mixing a binder with the fine particles of crushed coal. The binder is selected from the group consisting of petroleum residuum, derivatives of coal and lignin. The sixth step is rolling the mixture of fine particles of crushed coal and binder so as to form rounded, green agglomerates of coal not smaller than 100 mesh. The seventh step is heating the formed green agglomerates to remove excess moisture and produce stabilized coal pellets. By pellets, I mean agglomerating fine particles of coal to produce larger particles of coal having essentially rounded edges. The pellets may contain up to about 10% moisture by weight and provide sufficient strength to permit handling and storage until needed. The eighth step is entraining the stabilized coal pellets in a pressurized stream of air and injecting through the sides of a blast furnace by means of a lance passing through hot blast tuyeres. A supply of entrained coal pellets may be maintained in a pressurized bin in a relatively dense fluidized condition by an upwardly moving stream of air entering the bottom of the pressurized container and separate streams of entrained coal pellets may be fed to each injection lance from the bottom of the pressurized container.

Figure 2:
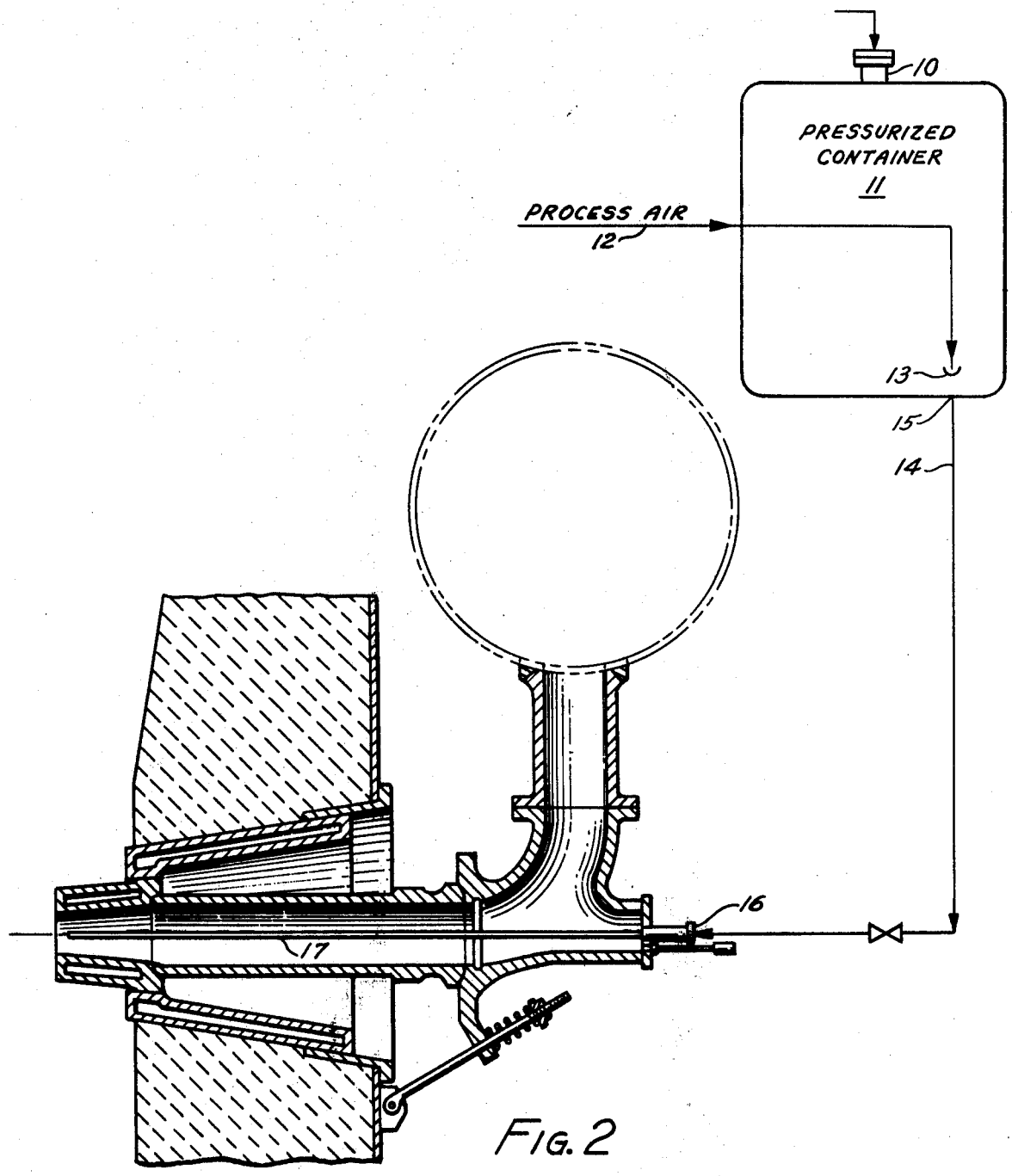
FIG. 2 is a drawing of a vertical section of a blast furnace illustrating an arrangement for the injection of pelletized coal through the hot blast tuyeres of a blast furnace.

FIG. 2 is a simple diagram illustrating one manner in which a supply of air-entrained coal pellets may be maintained in a fluidized condition in a pressurized container and fed into a blast furnace. In FIG. 2, coal pellets are charged through an opening in the top 10 of a pressurized container 11. A stream of process air 12 is deflected upwardly by striking a cone 13 to maintain the air-entrained coal pellets in a fluidized condition. A stream of air-entrained coal pellets enters conduit 14 from an opening in the bottom 15 of the pressurized container 11 and is fed through the conduit 14 to the breech end 16 of an injection lance 17. Various known alternate means (not shown) for a continuous injection of coal may be utilized for injecting pelletized coal.

More specifically, blast furnace coal injection of the prior art is directed toward minimizing the amount of coal which will pass through a 100 mesh screen and maximizing particles having a size of 10 mesh - 3/16 in. so as to provide good flow characteristics which would prevent plugging the coal conduits and injection lances. This relatively coarse crushed coal is not particularly well adapted for the separation of pyritic sulfur so it is essential to select coal containing limited sulfur.

Blast furnace injection of pelletized coal eliminates any necessity for such a restrictive selection of coals and for the first time makes it possible to use a free flowing, low sulfur pelletized coal for blast furnace injection. This is accomplished by the method of grinding, separating and pelletizing to rebuild the very fine particles of ground coal to produce rounded low sulfur pellets of coal up to about ¼ in. in diameter The total amount of sulfur contained in coal may be divided into two broad groups of chemical compounds. The first group includes sulfur in chemical combination with metals, principally iron, which is termed pyritic sulfur. The second group includes elemental sulfur and sulfur in combination with various organic compounds, most of which form hydrogen sulfide with the application of heat. The separation of coal particles on the basis of either size or density is very effective in removing pyritic sulfur but is ineffective in removing organic sulfur. In the method of this invention the first step in the production of pelletized coal for blast furnaces injection is a combination of grinding and separation of the coal particles on the basis of size and density. The effectiveness of removing sulfur will vary with the amount of sulfur contained in the coal as pyritic sulfur and the size of the particles of pyrite and ground coal. The favorable effect of fine grinding on the beneficiation of a high sulfur coal from the Ellsworth No. 58 Mine is a specific example of this invention. Table No. 1 shows a specific example of reducing the pyritic sulfur content of a high sulfur coal (Ellsworth Mine No. 58) produced by the combination of grinding and separating in accordance with the production of coal pellets for blast furnace injection in the manner of this invention.

TABLE NO. 1

| Product Size | Pyritic Sulfur | Organic Sulfur | Total Sulfur |
|---|---|---|---|
| Run of the Mine As Floated | | | |
| 1.6 Density | 1.44% | 1.00% | 2.44% |
| ¼" | 0.89% | 1.00% | 1.89% |
| 4 Mesh | 0.85% | 1.00% | 1.85% |
| 8 Mesh | 0.70% | 1.00% | 1.70% |
| 14 Mesh | 0.52% | 1.00% | 1.52% |
| 100 Mesh | 0.38% | 1.00% | 1.38% |
| 150 Mesh | 0.34% | 1.00% | 1.34% |

All % = percentage by weight

From Table No. 1 it is readily apparent that the pyritic sulfur content of coal is significantly reduced by the combination of grinding and separating coal in the manner of this invention but the organic sulfur is unaffected.

In the pelletization of coal for blast furnace injection it is preferred to use the size of coal of Table No. 1 that will pass through a 14 mesh screen. This is an optimum size which will result in a significant reduction in pyritic sulfur without encountering excessive costs for grinding and separating this particular coal. It is obvious that the effectiveness of grinding may be either better or worse as the different coals change in hardness, size and amount of pyritic sulfur content.

These 14 mesh and finer particles of coal are agglomerated by adding a binder such as petroleum residuum, a coal derivative or lignin, and then mixing and rolling to form round coal pellets in the manner disclosed in the U.S. Pat. No. 3,655,350 granted to R. W. Utley. The preferred size of the coal pellets in the specific example of this invention is not less than 100 mesh and it may be found desirable to adjust the moisture content of the pellets to less than 10% by weight to provide satisfactory strength and flow characteristics through the various bins, pipes and conduits of a typical coal injection system.

The blast furnace injection of pelletized coal is carried out by means of a fluidized stream of pelletized coal and compressed air at an ambient temperature. A suitable method for the injection of pulverized coal is disclosed in the U.S. Pat. No. 3,197,304 granted to J. C. Agarwal. The conduit for the fluidized stream of air and pelletized coal terminates at about the axial centerline hot blast tuyeres. The lance may be inserted into the tuyeres through the peephole of the downcomer or alternately through the side of either the tuyere of the blowpipe.

In the method of this invention the pelletized coal being injected into the blast furnace is heated in the injection lance by the sensible heat of the hot blast passing through the tuyeres. For the first time, round coal pellets are in rolling contact with the inside surface of the heated injection lance so as to provide more uniform heating without encountering the incipient fusion or melting coal particles in sliding contact with the injection tubes which caused plugging in the prior art. This difference is sufficient to extend the muzzle end of the injection tube to the same approximate location as the muzzle end of the tuyere. Furthermore, as the pelletized coal is suddenly exposed to the very high temperature above the hearth area of the furnace the pellets are rapidly decomposed and serve to enhance the combustion of the very fine particles of coal originally used to form the pellets.

Figure 3:
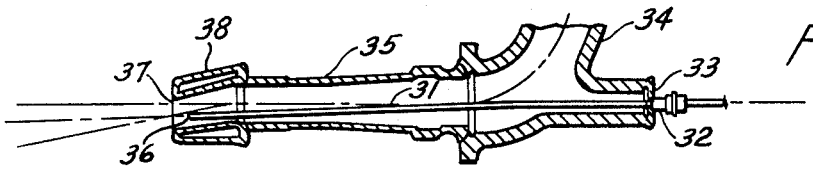
FIG. 3 and FIG. 4 are enlarged vertical sections of hot blast tuyeres illustrating alternative arrangement of lances for the injection of pelletized coal.

FIG. 3 illustrates an alternative arrangement of this invention in which an injection lance is adapted for use with an angle nose tuyere for the injection of pelletized coal. In FIG. 3, a straight injection lance tube 31 having its breach end 32 fitted to the peephole frame 33 in the hot blast downcomer elbow 34 and extending through the blowpipe 35 so as to have its muzzle end 36 terminating in the longitudinal axis at or about the orifice 37 of the water cooled, angle nose tuyere 38.

Figure 4:
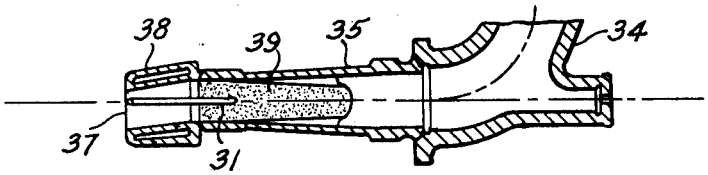
Figure 4A:
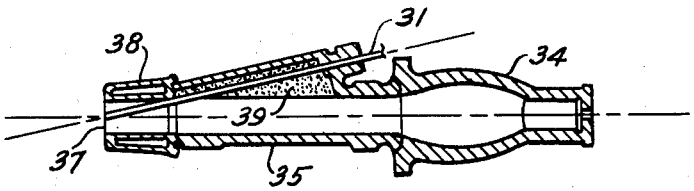
FIG. 4*a* is an enlarged horizontal section of the hot blast tuyere of FIG. 4.

FIGS. 4 and 4*a* are enlarged vertical and horizontal sections respectively illustrating another alternative arrangement of this invention in which the blowpipe is modified so as to permit continued usage of the peephole. In FIG. 4 and 4*a*, a modified blowpipe 35 having an asymmetrical projection is inclined at an acute angle to the centerline of the blowpipe to permit a straight injection lance tube 31 to enter this projected portion of the wall of the blowpipe 35 and terminate at about the centerline of the water cooled tuyere orifice 37. In FIG. 4*a* the asymmetrical projection portion of the blowpipe extending outside the cylindrical path of the hot blast is indicated as being filled with a suitable refractory 39 containing the breech portion of the injection lance.

Figure 5:
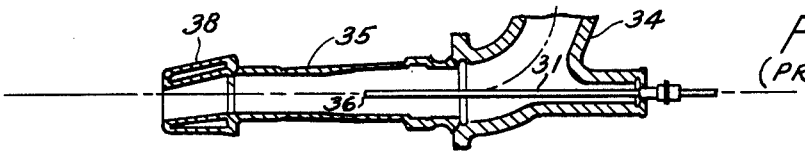
FIG. 5 (PRIOR ART)
FIGS. 5, 6 and 7 are enlarged vertical sections of prior art hot blast tuyere arrangements of lances for injecting coal.

In FIG. 5 a prior art arrangement of a short, straight injection lance 31 terminates in the general location of the longitudinal axis 38 of the blowpipe 35. This shortened injection lance is the usual means of eliminating accumulations of overheated coal in the bore of the prior art injection lances. However, the shortened lances do not solve the problem because they merely transfer the coal accumulations from the lance to either the blowpipe 35 or the water cooled tuyere 38 downstream of the lance orifice 38.

Figure 6:
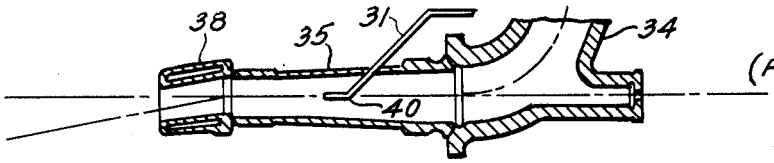
FIG. 6 (PRIOR ART)

In FIG. 6 another prior art arrangement having a shortened injection lance 31 is inserted through the wall of the blowpipe 35. This arrangement shortens the lance exposure to the temperature of the hot blast but requires at least one bend 40 inside the blowpipe. The change in direction of the coal flow at the lance bend 40 inside the blowpipe appears to increase the possibility for wear in the bore of the lance 31 without solving the problems with accumulation of melted coal in the downstream portions of the system.

Figure 7:
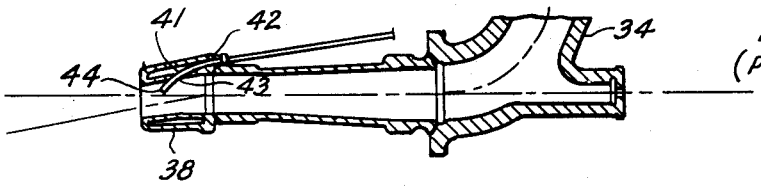
FIG. 7 (PRIOR ART)

In FIG. 7 another prior art arrangement is illustrated as having a curved lance 41 passing through the breech end 42 and bore 43 of the water cooled tuyere 38. This arrangement is difficult to produce and was unsatisfactory in service because the portion 44 of the lance extending beyond the bore of the water cooled tuyere 38 burned off in just a few hours.

I claim:

1. The method of smelting iron in a blast furnace having a smelting zone, a hearth section, and a plurality of tuyeres disposed between the smelting zone and hearth section for the introduction of low pyritic sulfur bearing coal pellets into said blast furnace, said method comprising:

a. crushing coal having a disproportionately large amount of pyritic sulfur into fine particles whose size is less than 14 mesh, b. separating the crushed fine particles by mechanical means into a first portion having a lower pyritic sulfur content than said coal prior to crushing, and a second portion having a higher pyritic sulfur content than said coal prior to crushing, c. mixing the first portion of the fine coal particles with a binder, d. forming such mixture of fine coal particles and binder into agglomerates, e. heating the agglomerates to form stabilized coal pellets low in pyritic sulfur, f. entraining the stabilized coal pellets in a fluid stream, and g. introducing the fluid stream of entrained low pyritic sulfur pellets through said tuyeres.

2. The method according to claim 1 wherein the first portion of the fine coal particles have a pyritic sulfur content no more than about 0.52% by weight.

3. The method according to claim 1 wherein the binder is a carbonaceous material selected from the group consisting of petroleum residuum, derivatives of coal and lignin.

4. The method according to claim 1 wherein the stabilized coal pellets are rounded and have a size greater than a 100 mesh screen.

5. The method according to clam 4 wherein the stabilized coal pellets have a maximum size of ¼ inches.

6. The method according to claim 1 wherein the moisture content of the stabilized coal pellets is less than 10%, by weight.

7. The method according to claim 1 wherein each said tuyere includes a blowpipe having its innermost end terminating at about the innermost end of the tuyere, and said entrained stabilized coal pellets are injected through said blowpipe.

8. The method according to claim 7 wherein said stabilized coal pellets are rounded and in rolling contact with said blowpipe.

* * * * *